US006041436A

United States Patent [19]

Keen

[11] Patent Number: 6,041,436

[45] Date of Patent: Mar. 28, 2000

[54] VERSATILE COSTUME SYSTEM

[76] Inventor: Warren J. Keen, 2 Hampden Way, Watford Hertsfordshire, United Kingdom, WD1 3SS

[21] Appl. No.: 09/204,453

[22] Filed: Dec. 3, 1998

[51] Int. Cl.[7] ..... A41D 1/00

[52] U.S. Cl. ..... 2/69; 2/456; 2/908; 2/912; 446/28; 446/98

[58] Field of Search ..... 2/102, 69, 115, 2/113, 108, 106, 105, 244, 246, 79, 227, 75, 74, 86, 455, 22, 23, 908, 911, 912, 913, 914, 919, 159, 161.1; 40/586; D2/741, 745, 746, 750; 446/98, 268, 321, 26, 28

[56] References Cited

U.S. PATENT DOCUMENTS

| | | | |
|---|---|---|---|
| D. 158,915 | 6/1950 | Voss | D3/17 |
| D. 283,172 | 4/1986 | Johnson | D2/79 |
| 3,382,504 | 5/1968 | Barbosa | 2/80 |
| 4,451,933 | 6/1984 | Seng et al. | 2/202 |
| 4,504,240 | 3/1985 | Thomas | 446/100 |
| 4,837,864 | 6/1989 | Thill | 2/244 |
| 5,054,127 | 10/1991 | Zevhak | 2/247 |
| 5,203,033 | 4/1993 | Sheppard et al. | 2/69 |
| 5,232,752 | 8/1993 | Crespi et al. | 428/15 |
| 5,416,928 | 5/1995 | Koenig | 2/244 |
| 5,588,895 | 12/1996 | Larson | 446/98 |
| 5,742,939 | 4/1998 | Williams | 2/69 |
| 5,894,600 | 4/1999 | Chenefront | 2/69 |
| 5,898,938 | 5/1999 | Baylor et al. | 2/161.1 |

*Primary Examiner*—John J. Calvert
*Assistant Examiner*—Tejash Patel

[57] ABSTRACT

A versatile costume system is provided including a body suit with a plurality of fasteners mounted thereon. Also included is a plurality of unique masks each adapted to be worn by a user. A plurality of resilient decorative plates are equipped with fasteners that are adapted to be removably attached to those of the body suit. It should be noted that the decorative plates each match one of the masks.

10 Claims, 3 Drawing Sheets

10
40
42
46
44
52
10
16
22
30
12
52
43
14
24
26
54
45
38
36
48
18
32
34
20
50

VERSATILE COSTUME SYSTEM

BACKGROUND OF THE INVENTION

1. Field of the Invention

The present invention relates to versatile garments and more particularly pertains to a new versatile costume system for facilitating an imagination and creativity of a child.

2. Description of the Prior Art

The use of versatile garments is known in the prior art. More specifically, versatile garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,416,928; U.S. Pat. No. 4,504,240; U.S. Pat. No. 3,382,504; U.S. Pat. Des. 283,172; U.S. Pat. No. 5,232,752; and U.S. Pat. No. 4,837,864.

In these respects, the versatile costume system according to the present invention substantially departs from the conventional concepts and designs of the prior art, and in so doing provides an apparatus primarily developed for the purpose of facilitating an imagination and creativity of a child.

SUMMARY OF THE INVENTION

In view of the foregoing disadvantages inherent in the known types of versatile garments now present in the prior art, the present invention provides a new versatile costume system construction wherein the same can be utilized for facilitating an imagination and creativity of a child.

The general purpose of the present invention, which will be described subsequently in greater detail, is to provide a new versatile costume system apparatus and method which has many of the advantages of the versatile garments mentioned heretofore and many novel features that result in a new versatile costume system which is not anticipated, rendered obvious, suggested, or even implied by any of the prior art versatile garments, either alone or in any combination thereof.

To attain this, the present invention generally comprises a flexible elastic body suit having a main body section including a front face, a rear face, and a top neck opening. The body suit further includes a pair of short sleeve arm portions and a pair of full length leg portions. Each of such portions are equipped with openings for passing limbs of a user when worn. As shown in FIG. 1, the front face of the main body section of the body suit has a plurality of horizontally oriented planar rectangular pile fasteners each having a length equal to a width of the main body section. Such pile fasteners include an upper pile fastener stitchedly mounted adjacent to the neck opening between the arm portions and a pair of lower pile fasteners. The lower pile fasteners each have a width less than that of the upper pile fastener and are positioned adjacent to the leg portions of the body suit. While not shown, the rear face of the main body section of the body suit has a horizontally oriented planar rectangular pile fastener stitchedly mounted thereon. Similar to those of the front face, the present pile fastener has a length equal to a width of the main body section. It should be noted that the pile fastener of the rear face of the main body section is positioned level with the upper pile fastener of the front face of the main body section. With continuing reference to FIG. 1, the arm portions of the body suit each have a vertically oriented pile fastener stitchedly mounted to a side surface thereof. Such pile fasteners each further extend between a top end of the arm portion to a midpoint of the associated arm portion. The leg portions of the body suit each have a vertically oriented upper pile fastener stitchedly mounted to a side surface of the leg portion and extending between a top end of the leg portion to a midpoint thereof. Associated therewith is a vertically oriented lower pile fastener stitchedly mounted to a front surface of each leg portion and extending between the midpoint of the leg portion to a bottom end thereof. As shown in FIG. 1, a pair of gloves are provided each having a top surface with a pile fastener mounted thereon. A plurality of unique hollow masks are provided which are each adapted to be worn by a user. Ideally, each mask completely covers the head of the user and has at least a pair of eye holes for allowing a user to see therethrough. In the preferred embodiment, tinted lengths are situated over the eye holes for further concealing the user. A plurality of resilient plates are included each having a unique decorative front surface which corresponds with each other and one of the masks. Together the masks and plates define a character selected from the group of characters including, but not limited to monsters, robots, heroes, or the like. Each of the plates further include at least one pile fastener for attaching to a corresponding pile fastener of the body suit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new versatile costume system apparatus and method which has many of the advantages of the versatile garments mentioned heretofore and many novel features that result in a new versatile costume system which is not anticipated, rendered obvious, suggested, or even implied by any of the prior art versatile garments, either alone or in any combination thereof.

It is another object of the present invention to provide a new versatile costume system which may be easily and efficiently manufactured and marketed.

It is a further object of the present invention to provide a new versatile costume system which is of a durable and reliable construction.

An even further object of the present invention is to provide a new versatile costume system which is susceptible of a low cost of manufacture with regard to both materials and labor, and which accordingly is then susceptible of low prices of sale to the consuming public, thereby making such versatile costume system economically available to the buying public.

Still yet another object of the present invention is to provide a new versatile costume system which provides in the apparatuses and methods of the prior art some of the advantages thereof, while simultaneously overcoming some of the disadvantages normally associated therewith.

Still another object of the present invention is to provide a new versatile costume system for facilitating an imagination and creativity of a child.

Even still another object of the present invention is to provide a new versatile costume system that includes a body suit with a plurality of fasteners mounted thereon. Also included is a plurality of unique masks each adapted to be worn by a user. A plurality of resilient decorative plates are equipped with fasteners that are adapted to be removably attached to those of the body suit. It should be noted that the decorative plates each match one of the masks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
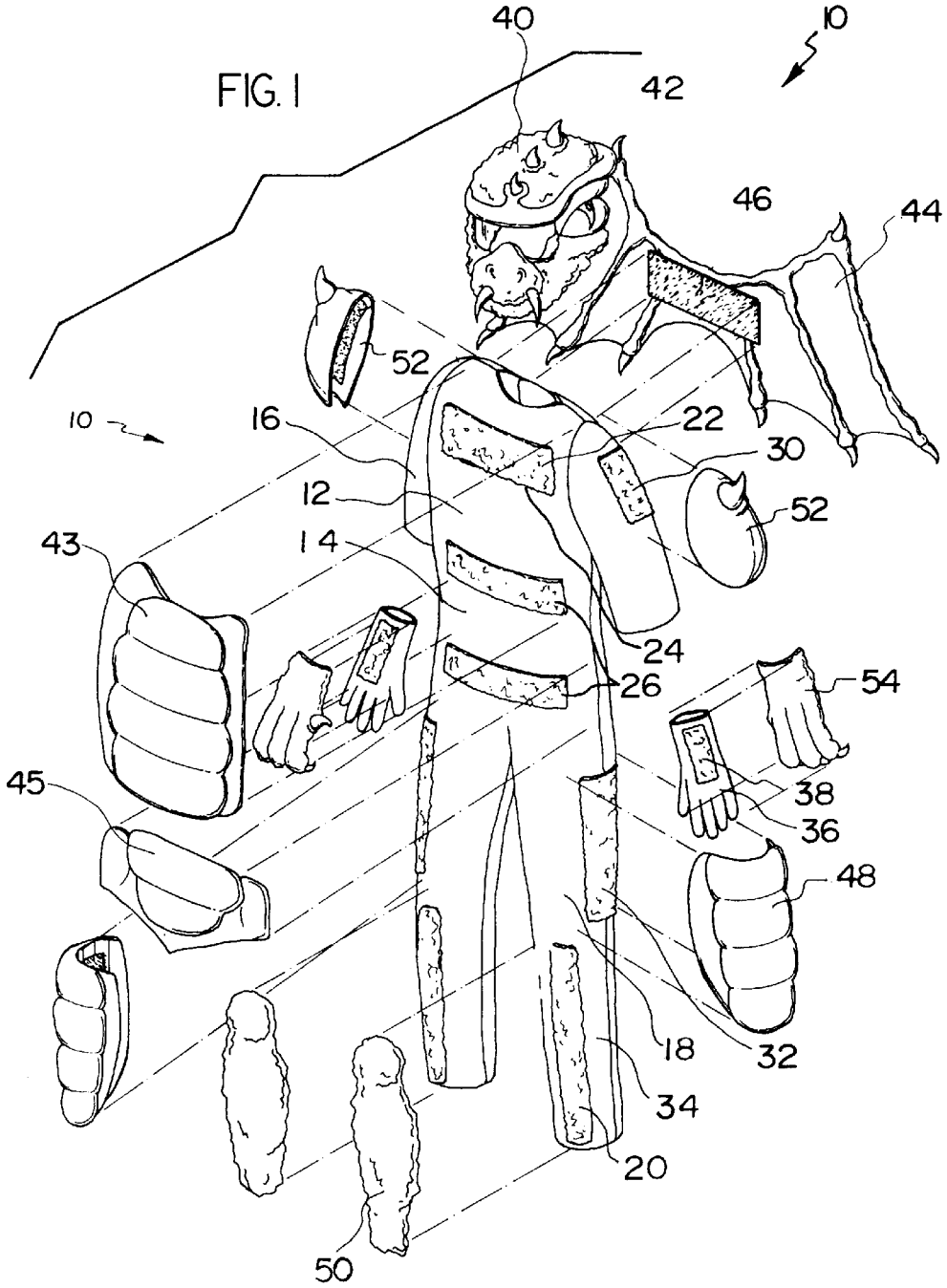
FIG. 1 is a front exploded view of a new versatile costume system according to the present invention.
Figure 2:
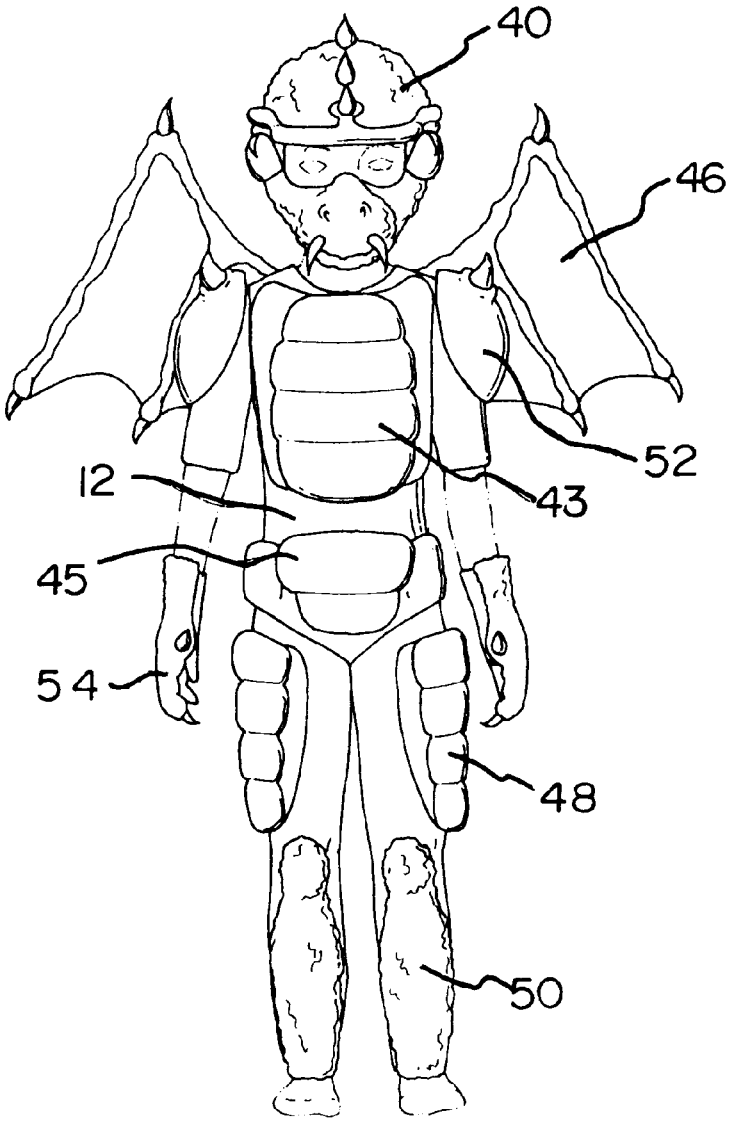
FIG. 2 is a front view of a first set of the plates and one of the masks of the present invention.
Figure 3:
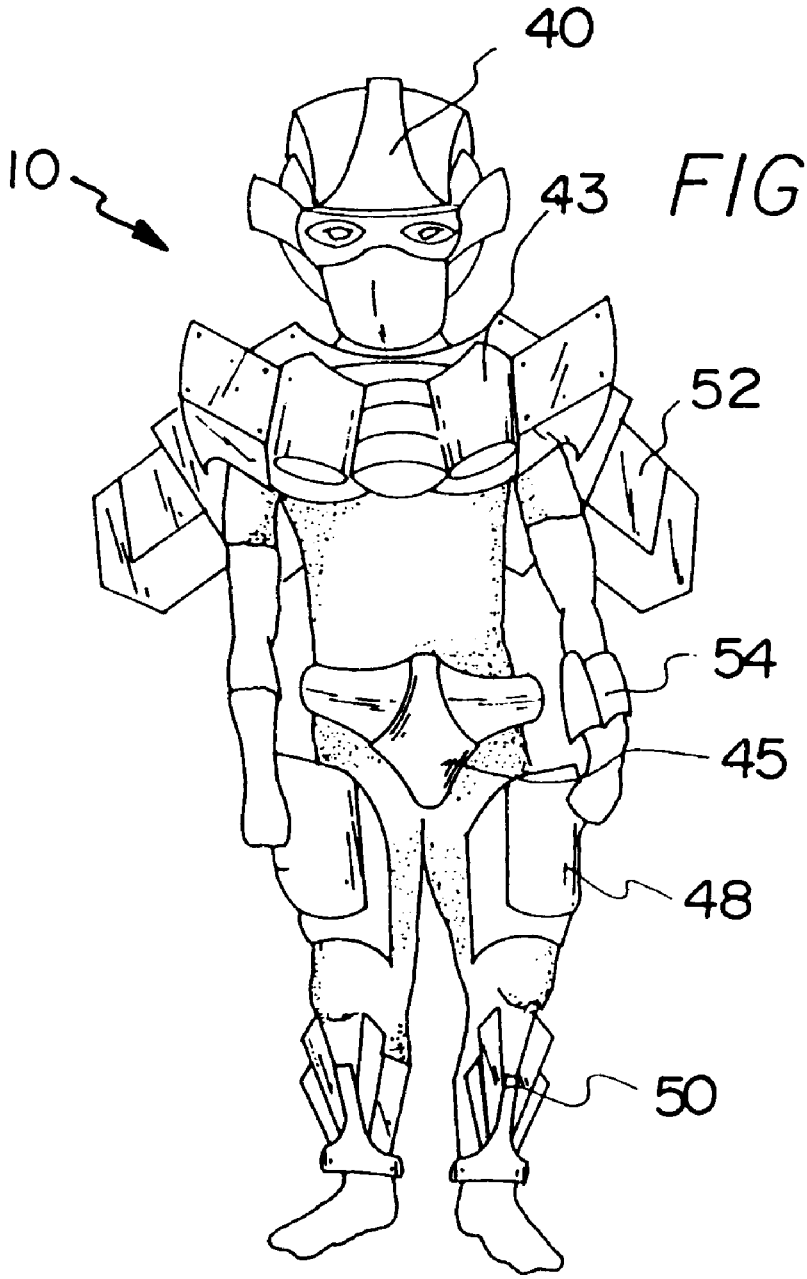
FIG. 3 is a front view of another set of the plates and another one of the masks of the present invention.

With reference now to the drawings, and in particular to FIGS. 1 through 3 thereof, a new versatile costume system embodying the principles and concepts of the present invention and generally designated by the reference numeral 10 will be described.

The present invention, designated as numeral 10, includes a flexible elastic body suit 12 having a main body section 14 including a front face, a rear face, and a top neck opening. Ideally, the body suit is constructed from either a Spandex TM or a Lycra TM material. The body suit further includes a pair of short sleeve arm portions 16 and a pair of full length leg portions 18. Each of such portions are equipped with openings 20 for passing limbs of a user when worn.

As shown in FIG. 1, the front face of the main body section of the body suit has a plurality of horizontally oriented planar rectangular pile fasteners 22 each having a length equal to a width of the main body section. Such pile fasteners include an upper pile fastener 24 stitchedly mounted adjacent to the neck opening between the arm portions and a pair of lower pile fasteners 26. The lower pile fasteners each have a width less than that of the upper pile fastener and are positioned adjacent to the leg portions of the body suit.

While not shown, the rear face of the main body section of the body suit has a horizontally oriented planar rectangular pile fastener stitchedly mounted thereon. Similar to those of the front face, the present pile fastener has a length equal to a width of the main body section. It should be noted that the pile fastener of the rear face of the main body section is positioned level with the upper pile fastener of the front face of the main body section of the body suit.

With continuing reference to FIG. 1, the arm portions of the body suit each have a vertically oriented pile fastener 30 stitchedly mounted to a side surface thereof. Such pile fasteners each further extend between a top end of the arm portion to a midpoint of the associated arm portion.

The leg portions of the body suit each have a vertically oriented upper pile fastener 32 stitchedly mounted to a side surface of the leg portion and extending between a top end of the leg portion to a midpoint thereof. Associated therewith is a vertically oriented lower pile fastener 34 stitchedly mounted to a front surface of each leg portion and extending between the midpoint of the leg portion to a bottom end thereof.

As shown in FIG. 1, a pair of gloves 36 are provided each having a top surface with a pile fastener 38 mounted thereon. A plurality of unique hollow masks 40 are provided which are each adapted to be worn by a user. Ideally, each mask completely covers the head of the user and has at least a pair of eye holes for allowing a user to see therethrough. In the preferred embodiment, tinted lenses 42 are situated over the eye holes for further concealing the user.

A plurality of resilient soft rubber plates 44 are included each having a unique decorative front surface which corresponds with each other and one of the masks. Together the masks and plates define a character selected from the group of characters including, but not limited to monsters, robots, heroes, dinosaurs, animals or the like.

Each of the plates further includes at least one pile fastener for attaching to a corresponding pile fastener of the body suit. In the preferred embodiment, a plurality of resilient breast plates 43 are included for attaching to the upper pile fastener and a uppermost one of the lower pile fasteners of the front face of the main body section of the body suit, a plurality of resilient midriff plates 45 are included for attaching to a bottommost one of the lower pile fasteners of the front face of the main body section of the body suit, a plurality of resilient back plates 46 are included for attaching to the pile fastener of the rear face of the main body section of the body suit, at least two pair of resilient arcuate thigh plates 48 are included for attaching to the upper pile fasteners of the leg portions of the body suit, at least two pair of resilient arcuate shin plates 50 are included for attaching to the lower pile fasteners of the leg portions of the body suit, at least two pair of resilient arcuate arm plates 52 are included for attaching to the pile fasteners of the arm portions of the body suit, and at least two pair of resilient hand plates 54 are included for attaching to the pile fasteners of the gloves. Each of the plates are preferably equipped with numerous tactile features including, but not limited to wings, horns, claws, and the like. Note FIGS. 1–3.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A versatile costume system comprising, in combination:

a flexible elastic body suit including a main body section having a front face, a rear face, and a top neck opening, the body suit further including a pair of short sleeve arm portions and a pair of full length leg portions each with openings for passing limbs of a user when worn;

said front face of the main body section of the body suit having a plurality of horizontally oriented planar rectangular pile fasteners each having a length equal to a width of the main body section and including an upper pile fastener stitchedly mounted adjacent to the neck opening between the arm portions and a pair of lower pile fasteners each with a width less than that of the upper pile fastener and positioned adjacent to the leg portions of the body suit;

said rear face of the main body section of the body suit having a horizontally oriented planar rectangular pile fastener stitchedly mounted thereon and having a length equal to a width of the main body section wherein the pile fastener of the rear face of the main body section is positioned level with the upper pile fastener of the front face of the main body section;

said arm portions of the body suit each having a vertically oriented pile fastener stitchedly mounted to a side surface of the arm portion and extending between a top end of the arm portion to a midpoint thereof;

said leg portions of the body suit each having a vertically oriented upper pile fastener stitchedly mounted to a side surface of the leg portion and extending between a top end of the leg portion to a midpoint thereof, each of said leg portions of the body suit further including a vertically oriented lower pile fastener stitchedly mounted to a front surface of the leg portion and extending between the midpoint of the leg portion to a bottom end thereof;

a pair of gloves each having a top surface with a pile fastener mounted thereon;

a plurality of unique face masks each adapted to worn by a user;

a plurality of resilient breast plates each having a unique decorative front surface and a pair of pile fasteners on a rear surface thereof for removably coupling with the upper pile fastener and an uppermost one of the lower pile fasteners of the front face of the main body section of the body suit;

a plurality of resilient midriff plates each having a unique decorative front surface and a pile fastener on a rear surface thereof for removably coupling with a bottommost one of the lower pile fasteners of the front face of the main body section of the body suit;

a plurality of resilient back plates each having a unique decorative rear surface and a pile fastener on a front surface thereof for removably coupling with the pile fastener of the rear face of the main body section of the body suit;

at least two pair of resilient arcuate thigh plates each having a unique decorative outer surface and a pile fastener on an inner surface thereof for removably coupling with the upper pile fasteners of the leg portions of the body suit;

at least two pair of resilient arcuate shin plates each having a unique decorative outer surface and a pile fastener on an inner surface thereof for removably coupling with the lower pile fasteners of the leg portions of the body suit;

at least two pair of resilient arcuate arm plates each having a unique decorative outer surface and a pile fastener on an inner surface thereof for removably coupling with the pile fasteners of the arm portions of the body suit; and at least two pair of resilient hand plates each having a unique decorative outer surface and a pile fastener on an inner surface thereof for removably coupling with the pile fasteners of the gloves.

2. A versatile costume system comprising:

a body suit with a plurality of elongate fastener strips mounted thereon, wherein the fastener strips extending horizontally across the body suit and having a length equal to a width of a main body portion of the body suit;

a plurality of unique masks each adapted to be worn by a user; and a plurality of resilient decorative plates with fasteners adapted to be removably attached to those of the body suit and matching one of the masks.

3. The versatile costume system as set forth in claim 2 wherein the elongate fastener strips are pile fasteners.

4. The versatile costume system as set forth in claim 2 wherein the body suit includes leg portions and the plates include thigh plates.

5. The versatile costume system as set forth in claim 2 wherein the body suit includes leg portions and the plates include shin plates.

6. The versatile costume system as set forth in claim 2 wherein the body suit includes arm portions and the plates include arm plates.

7. The versatile costume system as set forth in claim 2 wherein the plates include back plates.

8. The versatile costume system as set forth in claim 2 wherein the plates include midriff plates.

9. The versatile costume system as set forth in claim 2 wherein the plates include chest plates.

10. The versatile costume system as set forth in claim 2 and further including a plurality of unique pairs of hand plates for being releasably attached to fasteners of a pair of gloves.

* * * * *